United States Patent [19]

Hoppestad

[11] Patent Number: 4,949,614

[45] Date of Patent: Aug. 21, 1990

[54] PUNCH AND DIE SET

[75] Inventor: Gordon L. Hoppestad, Downers Grove, Ill.

[73] Assignee: Precision Brand Products, Inc., Downers Grove, Ill.

[21] Appl. No.: 368,835

[22] Filed: Jun. 20, 1989

[51] Int. Cl.[5] ..... B26D 1/00; B21D 53/20

[52] U.S. Cl. ..... 83/681; 10/72 R

[58] Field of Search ..... 10/72 R, 73, 85, 86 B; 83/33, 40, 95, 681

[56] References Cited

U.S. PATENT DOCUMENTS

| | | | |
|---|---|---|---|
| 1,659,161 | 2/1928 | Richer | 10/86 B |
| 1,752,982 | 4/1930 | Herold | 10/86 B |
| 1,785,281 | 12/1930 | Olson | 10/73 |
| 1,915,612 | 6/1933 | Olson | 10/86 B X |
| 2,086,435 | 7/1937 | Rapp | 83/681 X |
| 2,145,725 | 1/1939 | Jamieson | 83/681 X |
| 2,212,886 | 8/1940 | Ruland | 10/86 B |
| 2,266,555 | 12/1941 | Jordan et al. | 10/86 B |
| 2,295,583 | 9/1942 | Jordan | 10/86 B X |
| 2,352,118 | 6/1944 | Poupitch | 10/86 B X |
| 2,649,125 | 8/1953 | Poupitch | 10/86 B X |
| 2,744,268 | 5/1956 | Beart | 10/73 X |

FOREIGN PATENT DOCUMENTS 575882 3/1946 United Kingdom ..... 83/68

OTHER PUBLICATIONS

"Precision Brand," Precision Brand Products, Inc. Catalog 87, Copyright 1987, 3 Cover Pages and Page 15.

*Primary Examiner*—E. Michael Combs

*Attorney, Agent, or Firm*—Gerlach & O'Brien

[57] ABSTRACT

A manually operated punch and die set for making washers accurately includes a die having a series of die openings graduated according to diameter, a series of punches having cutting faces complementary to and received in the die openings for manually severing discs from sheet material and leaving corresponding graduated openings therein, a plurality of the punches each having a shank-receiving bore in its cutting face, a series of pilots having heads graduated in diameter to correspond to the diameters of a like number of graduated sheet material openings, each of the pilots having a shank joined to its head and removably received in each bore, whereby a pilot may be mounted on a cutting face of greater diameter than the head of the pilot for manual insertion of the head into a sheet material opening of corresponding diameter to orient the opening with respect to the cutting face, for severing from the sheet material an annular washer encompassing the opening.

4 Claims, 1 Drawing Sheet

PUNCH AND DIE SET

BACKGROUND OF THE INVENTION

This invention relates to manual punch and die sets, in particular, punch and die sets for making washers and the like from sheet material.

Small, portable, punch and die sets long have been used in tool rooms, maintenance shops, and the like, where they are conveniently used for making washers and the like, quickly and inexpensively, from metal, plastic and rubber sheet material. A conventional set includes a die constructed of a steel base block and a clear plastic upper guide block or top plate, secured together and spaced apart a distance sufficient to permit insertion of sheet material in the space between them.

Die openings graduated in diameter are provided by registering openings in the guide block and in the base block, on opposite sides of the space between them. Steel punches having sizes corresponding to the die openings are provided. With a sheet of suitable material inserted between the die blocks, a punch is inserted into one of the openings in the guide block, and then hit with a hammer in the hand of a worker, to severe or to punch out a disc from the material, leaving a corresponding opening in the material.

In making an annular washer or the like having an enclosed opening, the desired opening is provided in the sheet material as a first step. Then, the opening is shifted until it is encompassed by or centered in a larger die opening having a diameter equal to the outside diameter of a desired washer. The centering step is done visually, lining up center lines scribed on the sheet material with permanent center lines on the plastic guide block. The punch corresponding in diameter to the larger die opening is inserted in the opening in the guide block, and then struck with a hammer, to sever a washer from the sheet material, which is ejected beneath the base block.

It is difficult to consistently make washers or the like with accurately oriented or centered holes in them. One reason is that it is difficult to match accurately scribe lines on the sheet material with the center lines marked on the plastic block, in view of the fact that the scribe lines are hidden by the center lines above them. Also, the sheet material may be moved unintentionally after being properly oriented. Consequently, it may be necessary to repeat the procedure to make a satisfactory washer, wasting time and material. Alternatively, the worker may find it necessary to trim an inaccurate washer in some manner, such as by machining off part of the washer when it protrudes undesirably where it is being used.

SUMMARY OF THE INVENTION

The invention provides a punch and die set that eliminates the need for accurate visual alignment of a hole provided in sheet material, in making a washer accurately, as was required in the prior procedure. It also eliminates any loss of accuracy by movement of the sheet material once properly oriented.

The invention provides a punch and die set with which an essentially perfect washer or the like may be made manually, in a generally foolproof manner. Sheet material provided with a washer hole is positively oriented with respect to the die and held in the proper position within a larger die opening, secure against being moved, while the washer-making procedure is completed. Washers of various inside and outside diameters may be made, and each washer is made precisely in the correct dimensions the first time. No wasteful and time-consuming repetitions are needed, and the washers fit properly where used, with no need for any alteration. The high quality washers can be made quickly when needed, with no delay in operations.

More particularly, the invention provides a combination of a manually operated punch and die set including a die having a series of openings therethrough graduated according to diameter and a series of punches having cutting faces complementary to and received in the die openings for manually severing discs from sheet material and leaving corresponding graduated openings in the sheet material, and means adapted for use in making washers or the like from the sheet material which includes a series of pilots having heads graduated in diameter to correspond to the diameters of a like number of the graduated sheet material openings, each of the pilots having a shank joined to its head, and means providing a shank-receiving bore in the cutting face of each of a plurality of punches, each of the bores removably receiving each of the shanks therein, whereby a pilot may be mounted on a cutting face of greater diameter than the head of the pilot for manual insertion of the head into a sheet material opening of corresponding diameter to orient the opening with respect to the cutting face, for severing from the sheet material an annular washer encompassing the opening. Preferably, the shanks are received in the bores with a friction fit.

BRIEF DESCRIPTION OF THE DRAWINGS

The drawings illustrate a preferred embodiment of the invention, without limitation thereto. In the drawings, like elements are identified by like reference characters in each of the views, and.

The drawings illustrate the several elements of the new combination of die, punches and pilots in full size, drawn substantially to scale.

DESCRIPTION OF THE PREFERRED EMBODIMENTS

Figure 3:
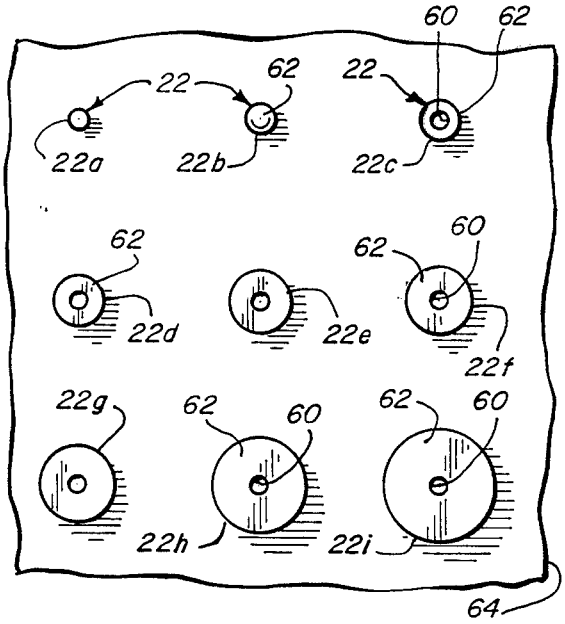
FIG. 3 is a plan view of a set of preferred punches employed in combination with the die of FIGS. 1 and 2, in accordance with the invention, illustrating the punches as they are supported in a matrix.
Figure 4:
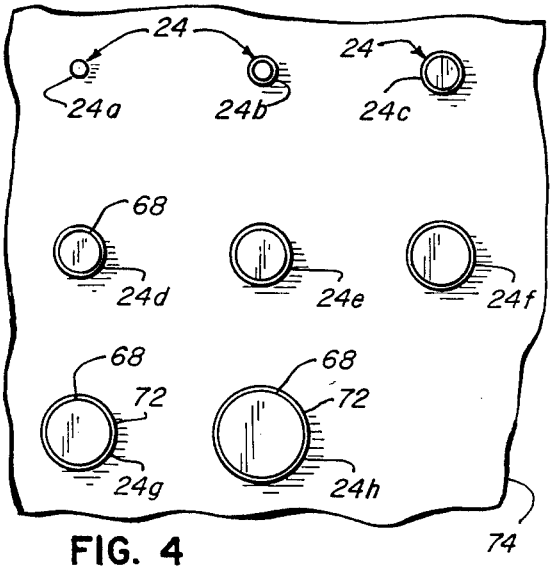
FIG. 4 is a plan view of a set of preferred pilots employed in combination with the die of FIGS. 1 and 2 and the punches of FIG. 3, in accordance with the invention, illustrating the pilots as they are supported in a matrix.

Referring to the drawings, an improved punch and die set constituting a preferred embodiment of the invention includes a die 20 (FIGS. 1 and 2), a series or set of punches 22 (FIG. 3), and a series or set of pilots 24 (FIG. 4). The punch and die set serves for accurately making washers, such as a washer 26 (FIG. 9), from sheet material 28 (FIGS. 6–8) inserted in the die 20.

Figure 1:
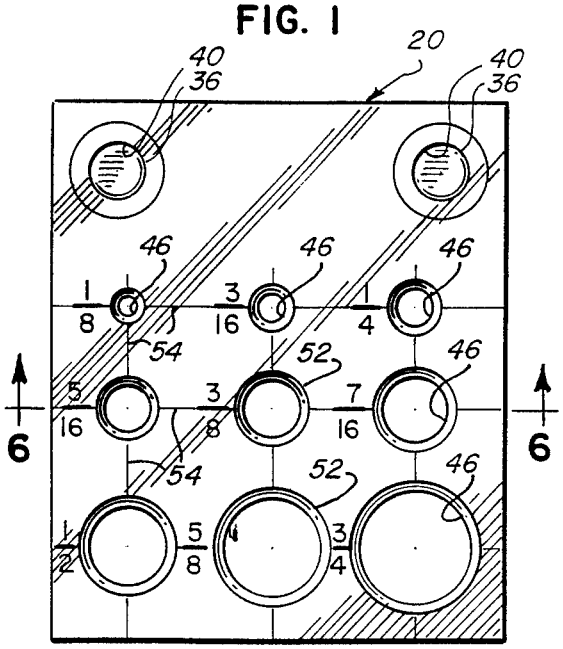
FIG. 1 is a top plan view of a preferred embodiment of a die employed in the invention.
Figure 2:
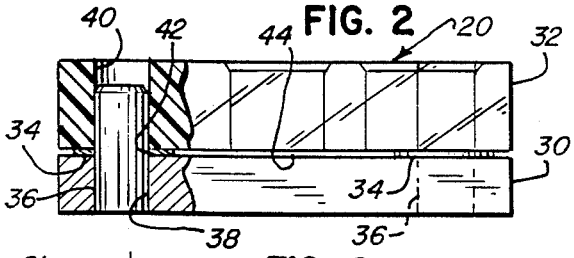
FIG. 2 is an end elevational view of the die, with a portion broken away and in section, to illustrate the manner in which the components of the die are secured together.

Referring to FIGS. 1 and 2, the die 20 is a rectangular unit composed of a rectangular lower base block 30, a rectangular upper guide block 32, spacers 34 inserted between the blocks, and a pair of dowel pins 36 adjacent to one end of the die 20 and inserted in registering cylindrical pin openings 38 and 40 in the base and guide blocks 30 and 32, respectively. The spacers 34 are in the form of washers having central circular openings 42 registering with the pin openings 38, 40, so that the dowel pins 36 extend through the spacers. The dowel pins 36 have a press fit in the openings 38, 40, whereby the blocks 30 and 32 are rigidly secured together and maintain a space 44 between them, sufficient to permit insertion of the sheet material 28 between the blocks, such space corresponding to the thickness of the spacers 34.

Referring to FIGS. 1 and 6–8, the die 20 has a series of cylindrical openings 46 extending therethrough, perpendicularly to the blocks 30, 32, and graduated according to diameter, from $\frac{1}{8}$th inch to $\frac{3}{4}$th inch, as illustrated in FIG. 1.

The base block 30 preferably is constructed of hardened and ground A-2 tool steel. It is provided with a cylindrical openings 48 constituting the lower portions of the die openings 46, and the upper peripheral edges of the base block openings 48 serve for severing discs from the sheet material 28, in cooperation with the punches 22.

The upper guide block 32 is provided with cylindrical openings 50, which are aligned with the openings 48 in the base block and constitute the upper portions of the die openings 46. The upper rims 52 of the guide block openings 50 are beveled, to facilitate insertion of the punches 22. The guide block 32 preferably is constructed of transparent or translucent rigid plastic, and on the underside thereof, center lines 54 are provided, for use in orienting the sheet material 28, if desired.

The die 20 as thus described is conventional. The punches 22 and the pilots 24 represent improved structures in accordance with the invention, which may be employed in combination with the conventional die 20, which is in widespread use and readily available, to provide an improved punch and die set, for making very accurate washers and the like.

Figure 5:
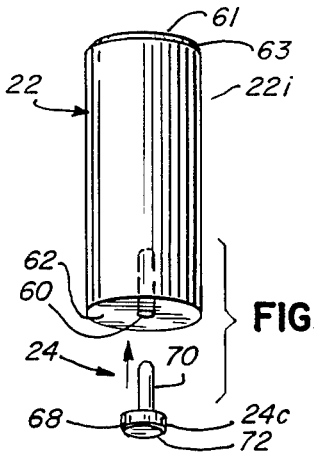
FIG. 5 is a perspective view of one of the punches and one of the pilots, as may be employed together in accordance with the invention.

The punches 22 of FIGS. 3 and 5 are constructed like the punches conventionally used with the die 20, and, in addition, each one of certain punches is provided with a cylindrical shank-receiving bore 60 that is concentric or coaxial with its punch, in the illustrative preferred embodiment. The punches 22 are cylindrical and preferably constructed of hardened A-2 tool steel, having ground cutting faces 62 and flat striking surfaces 61 with beveled or rounded edges 63. Each bore 60 is provided in the cutting face 62 of a punch. While a blind bore 60 is provided in the illustrative embodiment, the bore may, alternatively, be a through-bore, extending completely through the punch to the striking surface 61, in each punch. The punches 22 and particularly their cutting faces 62 are complementary to and received in respective die openings 46, with a slip fit of the punches for manually severing discs from sheet material and leaving corresponding graduated openings in the sheet material.

In the illustrative embodiment, no bore is provided in the punches **22*a* and 22*b* of smallest diameters. The remaining punches 22*c*–22*i* each have a bore 60 provided in its cutting face 62 and concentric therewith. The punches 22 are illustrated as being supported or mounted in openings of corresponding sizes in a matrix 64**, which may serve both as a packaging element and an organizer.

Referring to FIGS. 4 and 5, the pilots 24 are constructed of a cylindrical head 68 and a concentric or coaxial cylindrical shank 70. The shanks 70 of all of the pilots 24 have essentially the same diameter, which is substantially the same as the diameter of the punch bores 60, about $\frac{1}{8}$th inch in the illustrative embodiment.

The pilot heads 68 are graduated in diameter to correspond to the diameters of a like number of the graduated die openings 46. Thus, the diameters of the heads of the pilots **24*a*–24*h* are substantially the same as the diameters of the die openings 46, of from $\frac{1}{8}$th inch to $\frac{5}{8}$th inch diameter. In this case, no pilot having a head diameter of $\frac{3}{4}$th inch is provided. For ease and facility of use, the outer rim 72 of each of the pilot heads 68 is beveled. The pilots 24 are supported in a matrix 74 for packaging and organizing, similarly to the punches 22. The matrix 74 is provided with holes each having a diameter substantially equal to the diameter of the shanks 70, for receiving the shanks. The heads 68 seat on the outer surface of the matrix 74**.

Each of the bores 60 in the cutting faces 62 of the punches **22*c*–22*i* removably receives the shank 70 of each pilot 24. Preferably, the shanks are received in the bores with a friction fit, suitable for holding the pilots 24 in place on the punches 22 while in use, and enabling the pilots to be separated from the punches with the bare hand or using a manual tool, following use. It will be apparent, therefore, that each pilot 24 may be mounted on one or more cutting faces of greater diameter than the pilot head 68. Any of the eight pilots 24*a*–24*h* may be mounted on the cutting face 62 of the largest punch 22*i*, for making a washer having an inside diameter corresponding to the diameter of the pilot head 68. Lesser numbers of pilots 24 may be used alternatively with punches 22 of decreasing diameters, to produce washers. On the other hand, annular washers are not made with the smallest punches, 22*a* and 22*b*, which are not provided with shank-receiving bores 60** in the illustrative embodiment.

The punch and die set serves for making washers or the like from various types of sheet material. Reference to "washers or the like" herein is intended to encompass various annular articles by whatever name they may be called with reference to their functions, such as washers as traditionally used to make a seat for a bolt head or nut, and also articles termed spacers, shims, gaskets and the like. Such washers may be made from cut steel, brass shim, rubber or plastic to 0.025 inch thick, or stainless steel or blue temper steel to 0.010 inch thick, for example, employing the illustrative preferred embodiment of the invention.

Referring to FIGS. 1, 2 and 6–8, and in one manner of use, sheet material 28 haVing a desired composition is inserted in the space 44 between the blocks 30 and 32, for the purpose of severing or punching out a disc from the sheet material, to leave a circular opening therein. The opening is to become the opening in the center of a circular washer, employing the illustrative punch and die set. Before inserting the sheet, scribe lines or the like may be marked on the material, for the purpose of locating the center of the hole to be formed in the material. Alternatively, if the location on the sheet material of the opening to be made is of little or no significance, the scribe lines may be omitted, saving time.

Figure 6:
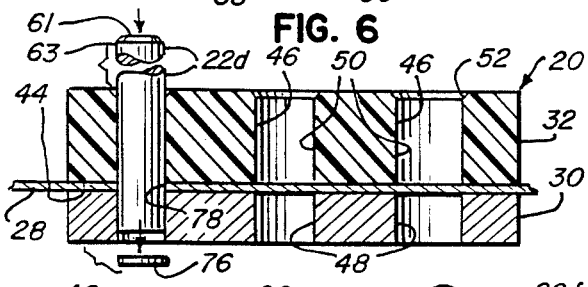
FIG. 6 is a cross-sectional view of the die, taken substantially on line 6—6 of FIG. 1, showing a punch in a complementary die opening, after severing a disc from sheet material inserted in the die.

FIG. 6 exemplifies the severing of a disc 76 from the sheet material 28, to leave a circular opening 78 in the material. Referring also to FIGS. 1 and 3, the disc 76 has been severed by the punch 22*d* inserted in the die opening 46 having a 5/16th inch diameter. If the sheet material had been provided with scribe lines for centering purposes, the lines would have been arranged to register with the center lines 54 marked on the inner surface of the guide block 32. Then, the sheet material opening 78 would be centered at a desired location on the material, the accuracy of centering depending on the care with which the scribe lines were aligned with the center lines 54 and the sheet material was prevented from moving during the punching step. The disc 76 is punched out simply by hitting the striking surface 61 of the punch 22*d* with a hammer, while the die 20 is placed so as to permit the disc 76 to drop beneath the base block 30, from where it is discarded.

In the example of FIGS. 6–9, the first punch 22*d* is removed, and the sheet material 28 having the opening 78 therein is shifted in the die 20, so as to locate the opening 78 within the confines of a larger die opening 46. In the illustration, the die opening is 7/16th inch in diameter, as seen as FIG. 1. The punch corresponding to this die opening is number 22*f*.

The sheet material opening 78 need only be approximately centered with respect to the die opening 46. This may be accomplished with or without the use of original scribe lines on the sheet material, which scribe lines if used may be aligned approximately with the center lines 54 on the guide block 32 adjacent to the 7/16th inch die opening.

In order to sever a washer 26 having an outside diameter of 7/16th inch and an inside diameter of 5/16th inch, as illustrated, the pilot 24*d* having the same head diameter as the punch 22*d* and its die opening, i.e., 5/16th inch, is removed from the pilot matrix 74. The pilot shank 70 (see FIG. 5) of the pilot 24*d* is inserted in the bore 60 extending inwardlY from the cutting face 62 of the punch 22*f*, until the head 68 of the punch is seated on the cutting face 62, whereupon the punch 22*f* is ready for use.

Figure 7:
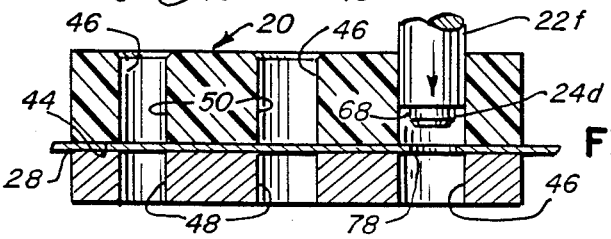
FIG. 7 is a cross-sectional view of the die, as in FIG. 6, with the sheet material having an opening therein shifted to a second position, with the opening registering with a larger die opening in which is inserted a complementary punch, shown fragmentarily, on the cutting face of which is mounted a pilot, illustrating a successive step in making a washer.
Figure 8:
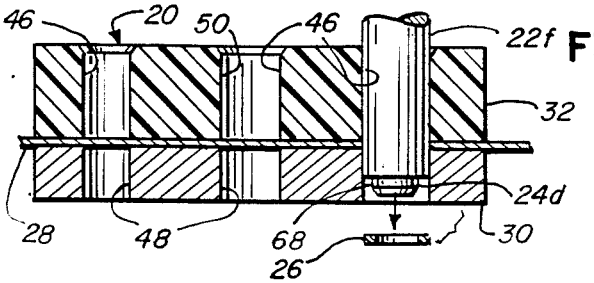
FIG. 8 is a view like FIG. 7, but showing the punch as it appears after being struck to sever a washer from the sheet material, in a succeeding step.
Figure 9:
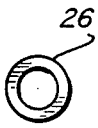
FIG. 9 is a plan view of the severed washer.

Referring to FIGS. 7 and 8, the punch 22*f* bearing the pilot 24*d* is inserted in the die opening 46 of 7/16th inch diameter, until the pilot head 68 enters the opening 78 in the sheet material 28. The punch is inserted so as to shift the sheet material 28 slightly, if need be, to permit insertion of the pilot head 68 into the sheet material opening 78, and as far as the cutting face 62. With the sheet material opening 78 precisely centered in the die opening 46, and also with respect to the cutting face 62, in this manner, the punch 22*f* is struck with a hammer, to sever the washer 26 and cause it to drop from the bottom of the guide block 32, as illustrated in FIG. 8. The washer 26, seen also in FIG. 9, is accurately sized for its intended use, with no need for altering it in any way.

The punch 22*f* bearing the pilot 24*d* may be tapped on its striking surface 61 to remove it from the die opening 46. The pilot 24*d* may be removed from the punch 22*f*, most conveniently with the fingers of the hand or with pliers or the like grasping the pilot head 68, for pulling the shank 70 out of the bore 60 in the punch. Alternatively, with a through-bore provided in the punch, instead of the blind bore 60, the pilot may be removed by tapping the shank 70, employing a tool inserted into the bore from the striking surface 61 of the punch. The punches 22*d* and 22*f* are restored to their matrix 64, for convenience in locating the proper punch size subsequently, for use in making the same or other washers.

In making washers having outer diameters from ¼th to ¾th inch, any lesser diameter may be selected for the inner diameter, with the washer opening provided by the corresponding punch of lesser diameter. The inside diameter for a ¾th inch o.d. washer may range from ⅛th inch to ⅝th inch, employing the appropriate punch 22*a*–22*h*. The corresponding pilot 24*a*–24*h* is selected for orienting the resulting sheet material opening 78 in the die opening 46 of ¾th inch diameter. FIG. 5 illustrates the largest punch 22*i* provided with the relatively small pilot 24*c*, to produce a washer having a ¾th inch o.d. and a ¼th inch i.d. With lesser outside diameters, correspondingly lesser numbers of inside diameters may be provided, employing a like number of punches 22 and a like number of pilots 24.

The sheet material 28 may be shifted either longitudinally or transversely of the die 20, for making washers having various outside and inside diameters. One sheet of material 28 may be used to produce a number of washers, of any size or sizes. The washers may be made very quickly and inexpensively, yet accurately, out of any suitable sheet material 28 kept on hand. Consequently, the punch and die set according to the invention achieves it maximum utility and is a valuable accessory for use in tool rooms, maintenance shops and other facilities where avoidance of delay, ability to meet various demands, and need for accuracy are important.

While a preferred embodiment of the invention has been illustrated and described, it will be apparent to those skilled in the art that various changes and modifications may be made therein. It is intended that all such changes and modifications be included within the scope of the claims.

I claim:

1. In combinations with a manually operated punch and die set including a die having a series of openings threrethrough graduated according to diameter, and a series of punches having cutting faces complementary to and received in said die openings for manually severing discs from sheet material and leaving corresponding graduated openings in the sheet material, means adapted for use in making washers or the like from the sheet material which comprises:

a series of pilots having heads graduated in diameter to correspond to the diameters of a like number of said graduated sheet material openings, each of said pilots having a shank joined to its head, and means providing a shank-receiving bore in the cutting face of each of a plurality of said punches, each of said bores removably receiving each of said shanks therein, whereby any of said pilots selectively may be removably mounted on any of the latter cutting faces of greater diameter than the head of the pilot for manual insertion of the head into a sheet material opening of corresponding diameter to orient the opening with respect to the cutting face, for severing from the sheet material an annular washer encompassing the opening.

2. A combination as defined in claim 1 wherein said shanks are received in said bores with a friction fit.

3. A combination as defined in claim 1 wherein said die comprises two blocks spaced apart a distance sufficient to permit insertion of said sheet material in the space between them, and said die openings comprise openings in each block aligned with openings in the other block on opposite sides of said space.

4. In combinations with a manually operated punch and die set including a die comprising two blocks spaced apart a distance sufficient to permit insertion of sheet material in the space between them, said die having a series of openings therethrough graduated according to diameter, said die openings comprising openings in each block aligned with openings in the other block on opposite sides of said space, and a series of punches having cutting faces complementary to and received in said die openings for manually severing discs from sheet material inserted in said space and leaving corresponding graduated openings in the sheet material, means adapted for use in making washers or the like from the sheet material which comprises:

a series of pilots having heads graduated in diameter to correspond to the diameters of a like number of said graduated sheet material openings, each of said pilots having a shank joined to its head, and means providing a shank-receiving bore in the cutting face of each of a plurality of said punches, each of said bores removably receiving each of said shanks with a friction fit therein, whereby any of said pilots selectively may be removably mounted on any of the latter cutting faces of greater diameter than the head of the pilot for manual insertion of the head into a sheet material opening of corresponding diameter to orient the opening with respect to the cutting face, for severing from the sheet material an annular washer encompassing the opening.

* * * * *